US007510278B2

(12) United States Patent
Matsui

(10) Patent No.: US 7,510,278 B2
(45) Date of Patent: Mar. 31, 2009

(54) IMAGE FORMING APPARATUS

(75) Inventor: Toshiharu Matsui, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 492 days.

(21) Appl. No.: 11/367,431

(22) Filed: Mar. 6, 2006

(65) Prior Publication Data

US 2006/0197819 A1 Sep. 7, 2006

(30) Foreign Application Priority Data

Mar. 4, 2005 (JP) ..... 2005-060724

(51) Int. Cl.
*B41J 2/01* (2006.01)
*B41J 29/13* (2006.01)

(52) U.S. Cl. ..... 347/104; 347/101; 347/108

(58) Field of Classification Search ..... 347/101, 347/104, 108
See application file for complete search history.

(56) References Cited

U.S. PATENT DOCUMENTS 3,918,701 A * 11/1975 Lee ..... 271/181
5,248,139 A * 9/1993 Garland et al. ..... 271/184
6,022,012 A * 2/2000 Worley ..... 271/3.14
6,810,231 B2 * 10/2004 Kobayashi et al. ..... 399/367
6,830,328 B2 * 12/2004 Cuyler, Jr. ..... 347/104
7,021,755 B2 * 4/2006 Ogura et al. ..... 347/104
7,349,647 B2 * 3/2008 Sugiyama ..... 399/107
7,413,186 B2 * 8/2008 Koga et al. ..... 271/145
7,413,187 B2 * 8/2008 Mitsuhashi ..... 271/162
2004/0012141 A1 * 1/2004 Hara et al. ..... 271/145

FOREIGN PATENT DOCUMENTS

JP 01017754 A * 1/1989
JP 03106725 A * 5/1991
JP 07-237337 A 9/1995
JP 11-222322 A 8/1999

* cited by examiner

*Primary Examiner*—Stephen D Meier
*Assistant Examiner*—Leonard S Liang
(74) *Attorney, Agent, or Firm*—Crowell & Moring LLP

(57) ABSTRACT

In an image forming apparatus such as an inkjet printer, deformation of a thick recording paper sheet such as a postcard in the conveyance thereof is prevented by a simple and inexpensive structure. A rectangular aperture corresponding to a size of the postcard is formed on a first tray portion, and a second tray portion is attached to the rectangular aperture. The second tray portion is rotatably borne at a front end thereof on the first tray portion, and linked with the first tray portion at a rear end by link members so that the rotation angle of the second tray portion with respect to the first tray portion is restricted. When the second tray portion is opened, the second tray portion is held with an elevation angle with respect to a paper conveying path gentler than that of the first-tray portion, so that the postcard can be inserted into the paper conveying path with a gentle elevation angle. Consequently, the deformation of the postcard can be prevented.

9 Claims, 4 Drawing Sheets

IMAGE FORMING APPARATUS

BACKGROUND OF THE INVENTION

1. Field of the Invention

The present invention relates to an image forming apparatus, such as an inkjet printer which is suitable for printing images on thick recording paper sheets such as postcards, and so on.

2. Description of the Related Art

Conventionally, techniques for feeding thick recording paper sheets such as postcards smoothly are proposed in a field of printers. For example, Japanese Laid-Open Patent Publication No. 11-222322 discloses a printer having a paper feed tray that an angle of a slope portion thereof provided to face rear faces of recording paper sheets is varied in conjunction with a motion of slidable guides contacting to both side of the recording paper sheets. However, the constitution of the paper feed tray becomes complex and a number of components constituting the tray increases, thereby causing the increase of cost of the printer.

On the other hand, Japanese Laid-Open Patent Publication No. 7-237337 discloses a portable printer which is used in a posture that a main body there of is erected when postcards or the like are printed. Although such a constitution is effective to be applied to a portable printer posture of which can easily be changed by a user, it is difficult to be applied to a stationary printer.

SUMMARY OF THE INVENTION

The present invention is conceived to solve the above mentioned problems of the conventional printers and purposed to provide an image forming apparatus, and especially, an inkjet printer of low cost and compact which cab feed thick recording paper sheets such as postcards smoothly without being deformed.

An image forming apparatus in accordance with an aspect of the present invention comprises a paper feed tray to which a recording paper sheet is loaded, a paper feed roller provided for facing the paper feed tray and feeding a recording paper sheet to a paper conveying path, and an image forming unit for forming an image on a recording paper sheet conveyed along the paper conveying path.

The paper feed tray has a first tray portion having a size capable of holding a first recording paper sheet of a first size which is a largest size printed by the image forming apparatus, is held on a main body of the inkjet printer so as to form a first elevation angle with the paper conveying path from the paper feed roller to the image forming unit, and has a rectangular aperture corresponding to a second recording paper sheet of a second size which is smaller than the first size, and a second tray portion attached to the rectangular aperture of the first tray portion.

The second tray portion can be held in a state to form a second elevation angle with the paper conveying path gentler than the first elevation angle when the second recording paper sheet of the second size which is thicker than the first recording paper sheet of the first size is loaded on the second tray portion.

By such a configuration, when an image is formed on a second recording paper sheet such as a postcard which is relatively thick, the second recording paper sheets are loaded on the second tray portion having the second elevation angle with respect to the gentler than that of the first tray portion, so that the second recording paper sheet can be inserted into the paper conveying path with the gentler elevation angle. Thus, the deformation of the second recording paper sheet in the conveyance along the paper conveying path due to, for example, paler feed roller can be prevented by simple and inexpensive structure that the second tray portion is only attached to the rectangular aperture formed on the first tray portion. Furthermore, the second tray portion can be formed to be stored in the rectangular opening when it is unused, so that increase of a space necessary to install the image forming apparatus can be prevented.

DETAILED DESCRIPTION OF THE EMBODIMENT

Figure 1:
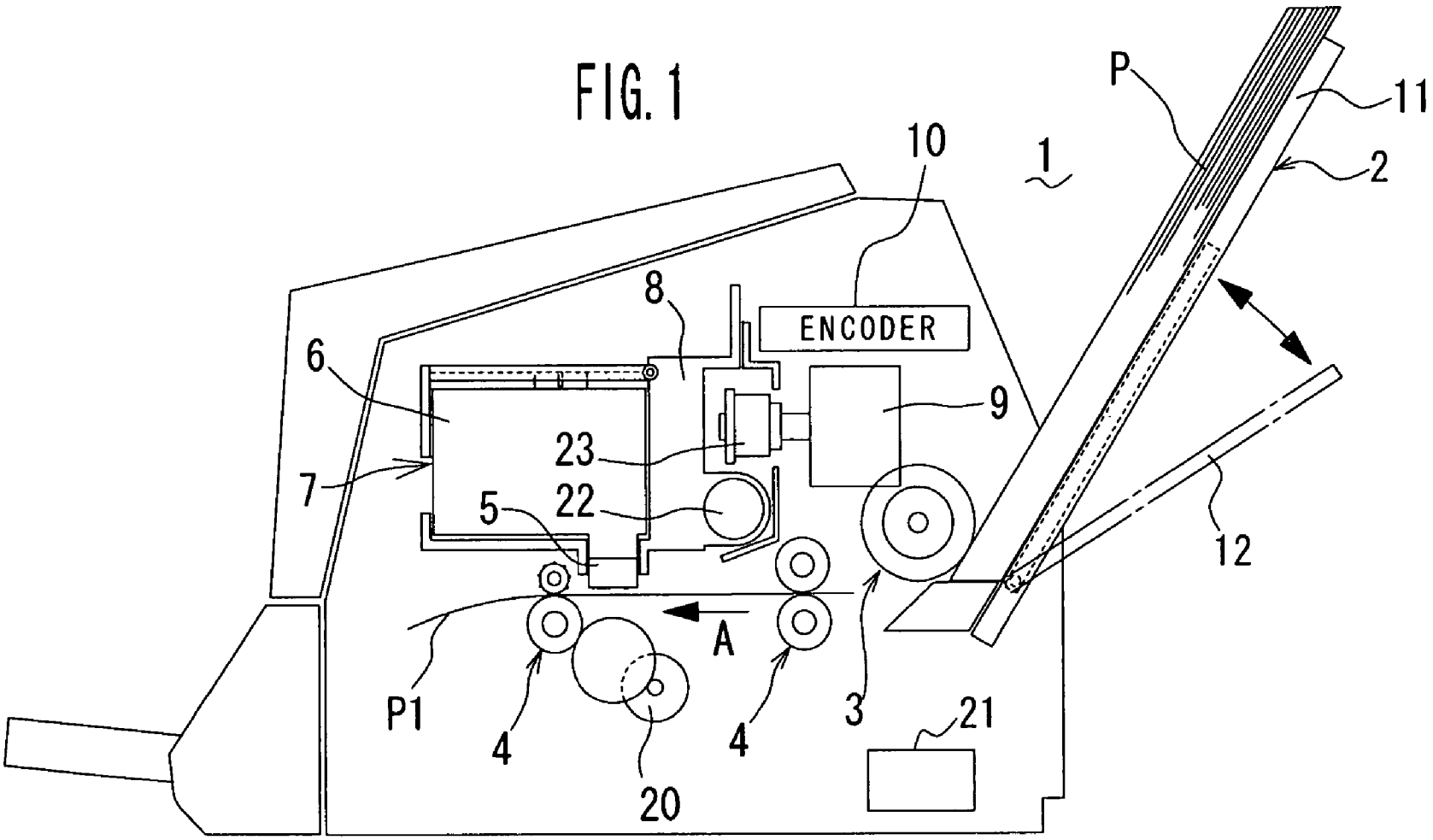
FIG. 1 is a sectional view showing a configuration on an inkjet printer as an example of an image forming apparatus in accordance with an embodiment of the present invention.

An inkjet printer which is an example of an image forming apparatus in accordance with an embodiment of the present invention is described with reference to figures. FIG. 1 shows a configuration of the inkjet printer.

The inkjet printer 1 comprises a paper feed tray 2 on which one or a plurality of recording paper sheets is loaded, a paper feed roller 3 provided to face a lower end portion of the paper feed tray 2 and picking up and conveying a recording paper sheet P into an inside of a main body of the printer 1, conveying rollers 4 for conveying a recording paper sheet P1 which is fed into the inside of the main body of the printer 1 along a paper conveying path A. A carriage 8 is provided above the paper conveying path A so that the carriage is slidably held on a shaft 22 in a direction perpendicular to a paper conveying direction and reciprocally moved along the shaft 22 by a driving force of a carriage driving motor 9 via a belt 23 and so on. An ink cartridge 7 is detachably mounted on the carriage 8. The ink cartridge 7 has a recording head 5 with nozzles for discharging ink drops to the recording paper sheet P1 conveyed along the paper conveying path A and ink tanks 6 for storing colored inks. The paper feed roller 3 and the conveying rollers 4 are driven by a paper feeding motor 20. Rotation of the carriage driving motor 9 and the paper feeding motor 20 are controlled with, for example, PWM (Pulse Width Modulation) control by the motor control circuit 21.

In this embodiment, a DC (direct current) motor which is low cost is applied for the carriage driving motor 9. A position of the carriage 8 is detected by an encoder 10 which is, for example, a linear encoder provided along a shaft 22 of the carriage 8, or a rotary encoder provided on an output shaft of the carriage driving motor 9.

Figure 2:
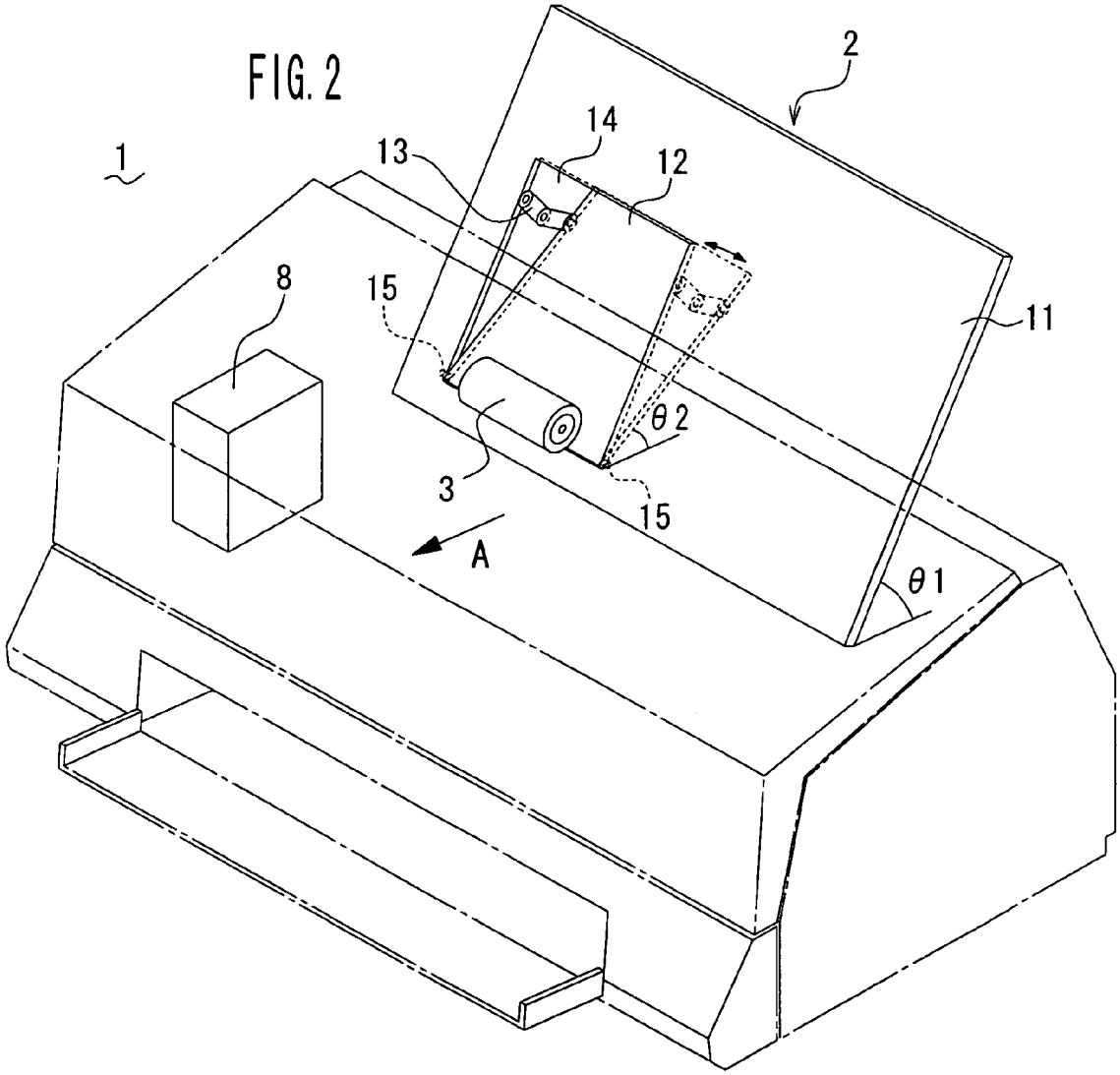
FIG. 2 is a perspective view showing a conformation of a paper feed tray of the above printer.

FIG. 2 shows a conformation of the paper feed tray 2. The paper feed tray 2 has a first tray portion 11 for holding at least one first recording paper sheet of a larger size (first size), for example, an A4 recording paper sheet and a second tray portion 12 for holding at least one second recording paper sheet of a smaller size (second size) such as a postcard. The second tray portion 12 is hinged or rotatably borne on the first tray portion 11 at a front end thereof and linked with the first tray portion 11 by link members 13 in the vicinity of a rear end thereof.

The first tray portion 11 has a size capable of holding the largest size of recording paper sheet such as the A4 recording paper sheet which can be printed by this inkjet printer 1, and is held on the main body of the inkjet printer 1 so as to form an elevation angle θ1 with the paper conveying path A. A rectangular aperture 14 corresponding to a size of, for example,.the postcard is formed a position on the first tray portion 11 distant a little from the center of the first tray portion 11 toward a waiting position (home position) of the carriage 8. The second tray portion 12 is attached to the rectangular aperture 14 and rotatably borne with respect to the first tray portion 11 by bearing portions 15 provided at positions in the vicinities of both front side ends of the second tray portion 12 near to the paper feed roller 3. The angle formed between the second tray portion 12 and the first tray portion 11 is restricted by the link members 13.

Figure 3:
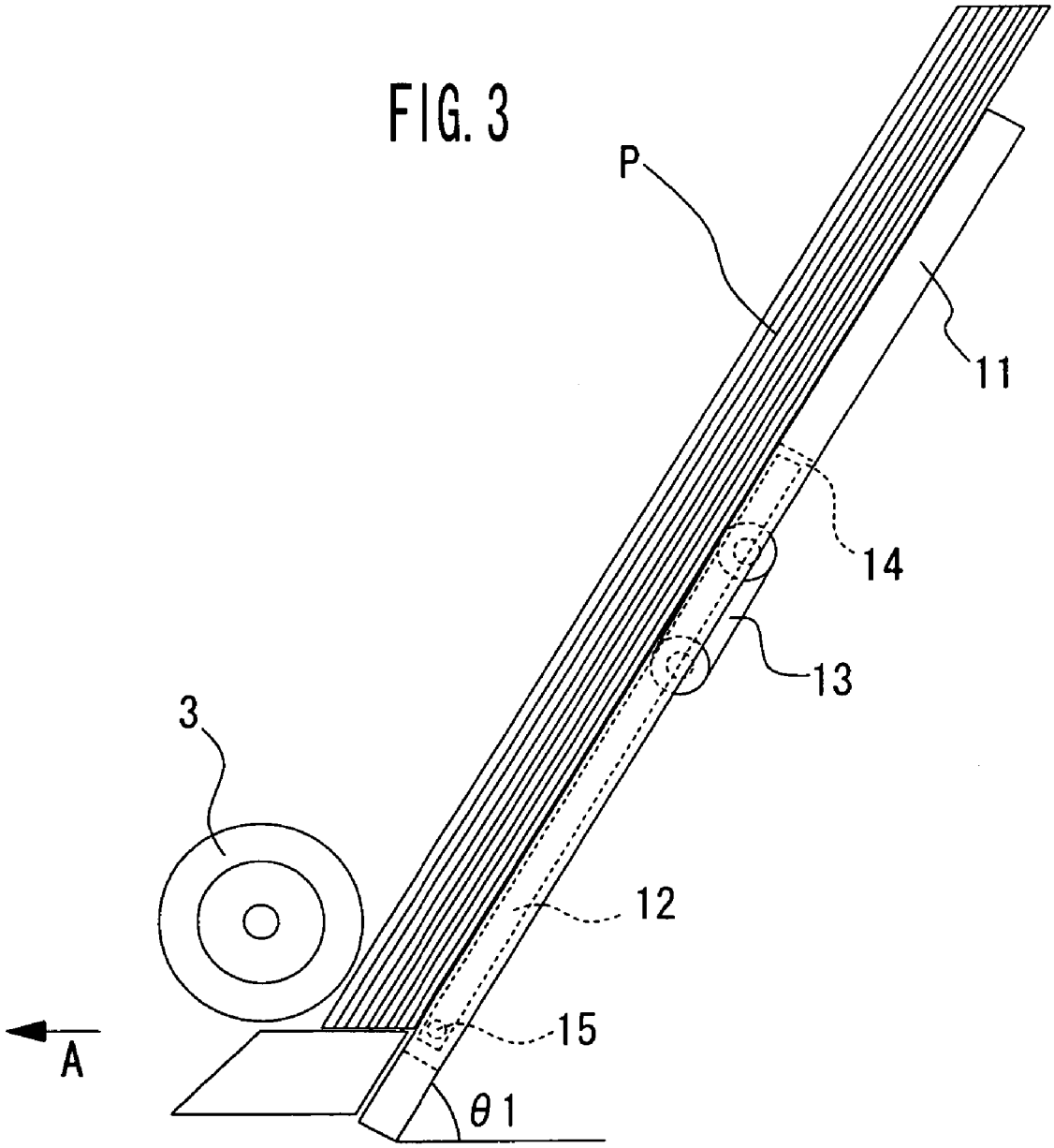
FIG. 3 is a side view showing a state of the paper feed tray when thin recording paper sheets such as A4 paper sheets are loaded on the tray.

FIG. 3 shows a state that the first recording paper sheets such as A4 paper sheets are loaded on the paper feed tray 2. In this case, the first recording paper sheets P are held by the first tray portion 11 and the second tray portion 12 stored in the rectangular aperture 14. At this time, a first elevation angle of each of the first recording paper sheet P is designated by a symbol θ1. The first elevation angle θ1 is set to a relatively larger angle so as to enable to load the first recording paper sheets as larger as possible while preventing upsizing of a space to which the inkjet printer 1 is installed. As for the first recording paper sheet P such as the A4 paper sheet, one having flexibility and relatively thin is widely circulated. Even though the first recording paper sheets are held by relatively larger first elevation angle 01, the first recording paper sheets P are rarely deformed or curled while they are conveyed by the paper feed roller 3.

Figure 4:
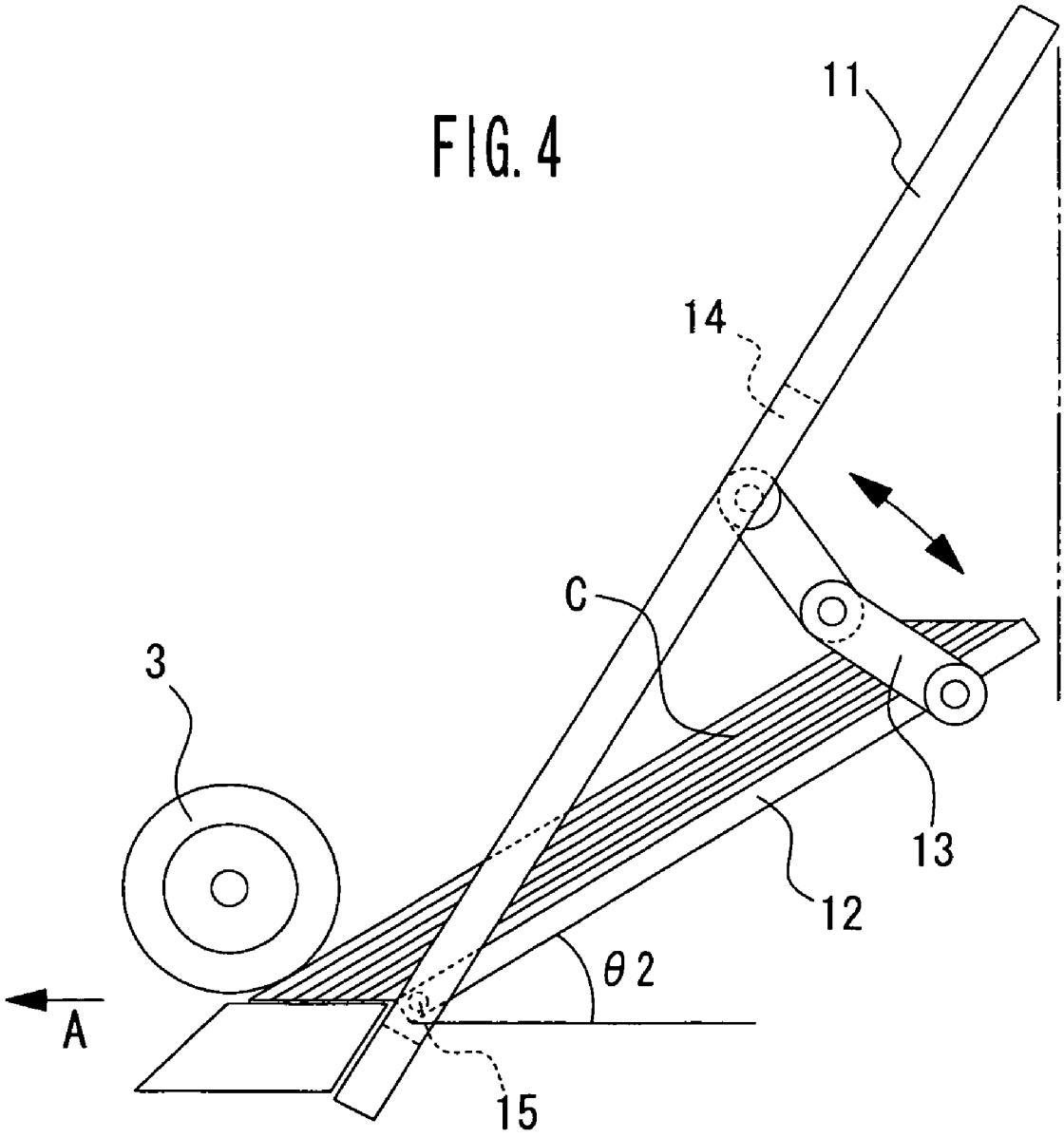
FIG. 4 is a side view showing another state of the paper feed tray when thick recording paper sheets such as postcards are loaded on the tray.

FIG. 4 shows a state that postcards C are loaded on the paper feed tray 2. In this case, the postcards C are held by the second tray portion 12 which is opened to backward from the first tray portion 11. At this time, since the second tray portion 12 becomes gentle in comparison with the first tray portion 11, the second elevation angle θ2 of the postcard C with respect to the paper conveying path A becomes smaller than the first elevation angle θ1. The postcards C are held in an angle gentler than that of the first recording paper sheets P shown in FIG. 3. Although a thick recording paper sheet is used for the postcard C, the second elevation angle θ2 of the postcards C with respect to the paper conveying path A can be made smaller in this embodiment, so that the postcards C are rarely deformed or curled while they are conveyed by the paper feed roller 3. Furthermore, the rear end of the second tray portion 12 is restricted so as not to protrude outward from the rear end of the first tray portion 11 by the link members 13. Still furthermore, both sides of the postcards C in the main scanning direction are restricted by contacting the edges of the rectangular aperture 14 and the link members 13.

According to the above inkjet printer 1 of this embodiment, the second tray portion 12 to which the postcards C are loaded is held with the second elevation angle θ2 with respect to the paper conveying path A which is gentler than the first elevation angle θ1 of the first tray portion 11, so that the postcard C can be inserted into the paper conveying path A with relatively gentle second elevation angle θ2. Consequently, it is possible to prevent the deformation of the postcard C while it is conveyed along the paper conveying path A by the paper feed roller 3 or the conveying rollers 4 by a simple and inexpensive structure.

Furthermore, only the second tray portion 12 is rotatable with respect to the first tray portion 1, and the rear end of the second tray portion 12 is disposed ahead of the rear end of the first tray portion 1 so that the second tray portion 12 may not be protruded from the first tray portion 11 when a contour of the inkjet printer is projected on a plane. Thereby, the inkjet printer 1 of this embodiment can be installed in substantially the same space for the conventional printer.

Still furthermore, both sides of the postcards C loaded on the second tray portion 12 is restricted by the link members 13 which link the second tray portion 12 with the first tray portion 11, so that the postcards C can be held in proper posture with a simple and inexpensive structure.

The present invention is not limited to the above mentioned description and illustration of the embodiment. It is sufficient that the second tray portion 12 be mounted with an elevation angle with respect to the paper conveying path which is gentler than that of the first tray portion. Furthermore, the size of the second tray portion 12 is not limited to correspond to the postcard, but it may correspond to a size of photographic paper sheet, for example, a size called L size which is widely used to be printed a photograph. Still furthermore, the application of the second tray portion 12 is not limited to the inkjet printer 1, so that it is applicable to various printers such as a laser beam printer, and so on.

The image forming apparatus in accordance with the present invention is needed to comprise a paper feed tray to which a recording paper sheet is loaded, a paper feed roller provided for facing the paper feed tray and feeding a recording paper sheet to a paper conveying path, and an image forming unit for forming an image on a recording paper sheet conveyed along the paper conveying path. The paper feed tray has a first tray portion having a size capable of holding a first recording paper sheet of a first size which is a largest size printed by the image forming apparatus, is held on a main body of the inkjet printer so as to form a first elevation angle with the paper conveying path from the paper feed roller to the image forming unit, and has a rectangular aperture corresponding to a second recording paper sheet of a second size which is smaller than the first size, and a second tray portion attached to the rectangular aperture of the first tray portion. And the second tray portion can be held in a state to form a second elevation angle with the paper conveying path gentler than the first elevation angle when the second recording paper sheet of the second size which is thicker than the first recording paper sheet of the first size is loaded on the second tray portion.

When an image is formed on a second recording paper sheet such as a postcard which is relatively thick, the second recording paper sheets are loaded on the second tray portion having the second elevation angle with respect to the gentler than that of the first tray portion, so that the second recording paper sheet can be inserted into the paper conveying path with the gentler elevation angle. Thus, the deformation of the second recording paper sheet in the conveyance along the paper conveying path due to, for example, paler feed roller can be prevented by simple and inexpensive structure that the second tray portion is only attached to the rectangular aperture formed on the first tray portion.

It is preferable that a rear end of the second tray portion be disposed ahead of a rear end of the first tray portion so that the second tray portion may not be protruded from the first tray portion when a contour of the inkjet printer is projected on a plane. By such a configuration, the image forming apparatus in accordance with the present invention can be installed to a space where the conventional image forming apparatus has been installed without increasing the space.

Furthermore, it is preferable that the second tray portion be rotatably borne with respect to the first tray portion 11 by bearing portions provided at positions in vicinities of both front side ends of the second tray portion near to the paper feed roller. By such a configuration, the second tray portion can be stored in the rectangular opening when it is unused, so that increase of a space necessary to install the image forming apparatus can be prevented.

Still furthermore, it is preferable that the second tray portion be linked with the first tray portion by link members in a vicinity of a rear end thereof, and an angle formed between the second tray portion and the first tray portion be restricted by the link members. By such a configuration, the second elevation angle of the second tray portion with respect to the paper conveying path can be maintained stable even when the second tray portion is operated repeatedly.

Still furthermore, when the recording paper sheet of the second size is loaded on the second tray portion, both sides of the recording paper sheet in a direction perpendicular to a paper conveying direction are restricted by contacting with edges of the rectangular aperture and the link members. By such a configuration, the second recording paper sheet can be conveyed along the paper conveying path so that both sides of the second recording paper sheet are substantially parallel to the paper conveying direction. Consequently, quality of the image formed on the second recording paper sheet may not be damaged.

Still furthermore, it is preferable that the image forming apparatus be an inkjet printer having a carriage which is reciprocally moved in a direction perpendicular to a paper conveying direction, and the rectangular opening be formed a position on the first tray portion distant a little from center of the first tray portion toward a waiting position of the carriage. By such a configuration, the moving distance of the carriage can be shortened when the image is formed on the second recording paper sheet.

This application is based on Japanese patent application 2005-60724 filed Mar. 4, 2005 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising: a paper feed tray to which a recording paper sheet is loaded; a paper feed roller provided for facing the paper feed tray and feeding a recording paper sheet to a paper conveying path; and an image forming unit for forming an image on a recording paper sheet conveyed along the paper conveying path; wherein the paper feed tray has a first tray portion having a size capable of holding a first recording paper sheet of a first size which is a largest size printed by the image forming apparatus, is held on a main body of the inkjet printer so as to form a first elevation angle with the paper conveying path from the paper feed roller to the image forming unit, and has a rectangular aperture corresponding to a second recording paper sheet of a second size which is smaller than the first size, and a second tray portion attached to the rectangular aperture of the first tray portion; and the second tray portion can be held in a state to form a second elevation angle with the paper conveying path gentler than the first elevation angle when the second recording paper sheet of the second size which is thicker than the first recording paper sheet of the first size is loaded on the second tray portion.

2. The image forming apparatus in accordance with claim 1, wherein a rear end of the second tray portion is disposed ahead of a rear end of the first tray portion so that the second tray portion may not be protruded from the first tray portion when a contour of the inkjet printer is projected on a plane.

3. The image forming apparatus in accordance with claim 1, wherein the second tray portion is rotatably borne with respect to the first tray portion by bearing portions provided at positions in vicinities of both front side ends of the second tray portion near to the paper feed roller.

4. The image forming apparatus in accordance with claim 3, wherein the second tray portion is linked with the first tray portion by link members in a vicinity of a rear end thereof;and an angle formed between the second tray portion and the first tray portion is restricted by the link members.

5. The image forming apparatus in accordance with claim 4, wherein the rear end of the second tray portion is disposed ahead of a rear end of the first tray portion so that the second tray portion may not be protruded from the first tray portion when a contour of the inkjet printer is projected on a plane.

6. The image forming apparatus in accordance with claim 4, wherein when the recording paper sheet of the second size is loaded on the second tray portion, both sides of the recording paper sheet in a direction perpendicular to a paper conveying direction are restricted by contacting with edges of the rectangular aperture and the link members.

7. The image forming apparatus in accordance with claim 1, wherein the image forming apparatus is an inkjet printer having a carriage which is reciprocally moved in a direction perpendicular to a paper conveying direction; and the rectangular opening is formed a position on the first tray portion distant a little from center of the first tray portion toward a waiting position of the carriage.

8. An inkjet printer comprising: a paper feed tray to which a recording paper sheet is loaded; a paper feed roller provided for facing the paper feed tray and feeding a recording paper sheet to a paper conveying path; an ink cartridge having at least one ink tank each for storing a colored ink and at least one recording head from which drops of the colored ink are discharged to a recording paper sheet conveyed along the paper conveying path; and a carriage reciprocally moved in a direction perpendicular to a paper conveying direction with carrying the ink cartridge; wherein the paper feed tray has a first tray portion having a size capable of holding a first recording paper sheet of a first size which is a largest size printed by the image forming apparatus, is held on a main body of the inkjet printer so as to form a first elevation angle with the paper conveying path from the paper feed roller to the image forming unit, and has a rectangular aperture corresponding to a second recording paper sheet of a second size which is smaller than the first size, and a second tray portion attached to the rectangular aperture of the first tray portion;

the second tray portion is rotatably borne with respect to the first tray portion by bearing portions provided at positions in vicinities of both front side ends of the second tray portion near to the paper feed roller and linked with the first tray portion by link members in a vicinity of a rear end thereof, thereby restricting an angle formed between the second tray portion and the first tray portion is restricted by the link members, so that the second tray portion can be held in a state to form a second elevation angle with the paper conveying path gentler than the first elevation angle;

the rear end of the second tray portion is disposed ahead of a rear end of the first tray portion so that the second tray portion may not be protruded from the first tray portion when a contour of the inkjet printer is projected on a plane, thereby enabling to increase a space where the inkjet printer is installed;

when the recording paper sheet of the second size is loaded on the second tray portion, both sides of the recording paper sheet in a direction perpendicular to a paper conveying direction are restricted by contacting with edges of the rectangular aperture and the link members; and when an image is formed on a second recording paper sheet of the second size which is thicker than the first recording paper sheet of the first size, the second recording paper sheet is loaded on the second tray portion so that the second recording paper sheet is inserted into the paper conveying path with the second elevation angle, thereby enabling to prevent deformation of the second recording paper sheet in conveyance of the second recording paper sheet along the paper conveying path.

9. The inkjet printer in accordance with claim 8, wherein the recording paper sheet of the second size is a postcard.

* * * * *